US005249796A

United States Patent [19]

Silvi

[11] Patent Number: 5,249,796

[45] Date of Patent: Oct. 5, 1993

[54] CONVERTIBLE SPORTS GOAL APPARATUS

[76] Inventor: Paul Silvi, 2642 Beacon Hill Apt. 311, Auburn Hills, Mich. 48236

[21] Appl. No.: 746,433

[22] Filed: Aug. 16, 1991

[51] Int. Cl.[5] ..... A63B 67/00

[52] U.S. Cl. ..... 273/55 D; 273/127 R

[58] Field of Search ..... 273/126 R, 127 R, 127 A, 273/127 B, 26 A, 181 R, 181 A, 181 F, 181 J, 181 K, 182 R, 127 C, 29 A, 55 D, 410, 411, 407

[56] References Cited

U.S. PATENT DOCUMENTS

| | | | |
|---|---|---|---|
| 2,070,125 | 3/1937 | Lefft et al. | 273/55 D |
| 2,125,679 | 8/1938 | Longstreet | 273/55 B |
| 3,408,071 | 10/1968 | Lundy | 273/26 A |
| 3,981,501 | 9/1976 | Gonzalez | 273/55 D |
| 4,169,598 | 10/1979 | Taylor | 273/127 B |
| 4,295,648 | 10/1981 | Stromback | 273/26 A |
| 4,437,616 | 3/1984 | Chavez | 273/55 D |
| 4,650,189 | 3/1987 | Rajacich | 273/26 A |
| 4,664,384 | 5/1987 | Solla | 273/55 D |
| 4,762,319 | 8/1988 | Krumholz | 273/165 R |
| 4,786,053 | 11/1988 | Barnes, Jr. | 273/15 R |
| 4,836,542 | 6/1989 | Crawley | 273/55 B |
| 4,932,657 | 6/1990 | Hailer et al. | 273/26 A |
| 4,969,651 | 11/1990 | Comartin | 273/410 |

FOREIGN PATENT DOCUMENTS

| | | | |
|---|---|---|---|
| 2650289 | 11/1978 | Fed. Rep. of Germany | 273/127 R |

*Primary Examiner*—Theatrice Brown

*Attorney, Agent, or Firm*—Dykema Gossett

[57] ABSTRACT

A convertible sports apparatus is disclosed which can be easily modified between a goal, a football goal post, and a ball return mechanism. The structure is modified by moving standard pipe connection structures with a few simple movements. Vertical columns define the lateral sides of the goal. Post members are telescopically received within the column to form the uprights of the football goal post. The side members of the goal are selectively pivotable to define the ball return mechanism.

9 Claims, 3 Drawing Sheets

CONVERTIBLE SPORTS GOAL APPARATUS

BACKGROUND OF THE INVENTION

This application in general relates to a sports apparatus that can be utilized to play or practice several distinct sports.

Sports apparatus such as goals, football goal posts, and ball return mechanisms are known. Ball return mechanisms are commonly known as "pitch-back-devices." Each of these devices are individually relatively large, and thus large amounts of space are required to store individual ones of each items.

It is known to utilize a single convertible item as several sports devices. As an example, U.S. Pat. No. 4,762,319 discloses a convertible sports stand which can be used as a basketball rim, a ball return-type net, and can also be used as a throwing target.

U.S. Pat. No. 4,786,053 discloses a sporting device that can be used for a variety of purposes, including a basketball rim, a football goal post, and also a goal for different types of games.

The above-described items allow a user to have a variety of types of sporting devices available by modifying the single device. These devices have not, however, incorporated structure for certain types of sporting devices. Further, the above-described devices have been relatively complex, and difficult to modify into the various types of sporting devices.

It is therefore an object of the present invention to disclose a convertible sports apparatus which can be easily modified into several types of devices. More particularly, it is an object of the present invention to disclose such an apparatus which can be modified into a football goal post, a ball return mechanism and a goal.

SUMMARY OF THE INVENTION

The present invention discloses a convertible sports apparatus which can be easily modified to be a football goal post, a goal for soccer and similar sports, or a ball return mechanism. The disclosed structure allows a user to convert between these various devices easily and efficiently.

The convertible sports apparatus disclosed in this application is preferably a small scale representation useful as a toy or novelty item. For that reason, the dimensions of the sporting devices, and in particular the soccer goal and football goal posts are not true to those used in professional sports. Nevertheless, the convertible sports apparatus is useful as a play or training device.

In a disclosed embodiment the apparatus consists of two generally elongate, vertically extending columns which are parallel to each other and spaced by a first distance. A cross member connects the two vertical columns at a vertically upper position, and extends across the distance between the two. The columns and cross bar form the opening to a goal, or alternatively the bottom of a football goal post, with the cross member being the cross bar for the goal post. The vertical columns have members which are telescopically received within them. These members are selectively removable, vertically upwardly to extend above the cross bar and define uprights for the goal post. Thus, a user may easily change the convertible sports apparatus of this invention from a goal to a football goal post by merely removing the vertically extending telescopic members from the vertical columns. A net used with the goal may also be removed.

In another feature of the present invention, a side structure extends rearwardly from each vertical column to define the sides of the goal. The side structures include top and bottom side members. The top side member is selectively pivotable between a first position where it extends generally parallel to the ground and is connected by a four-way connector to both the cross member and the vertical column, to a removed position. In the removed position the top side members on each side and the cross member are unconnected to the vertical columns and extend at an angle upwardly from the ground. Once the top side members and upper cross members are moved to the removed position, the back side members, the top side members and the cross member form a ball return mechanism.

A net is positioned around the sides and back of the goal to catch balls which enter the goal. The net may be formed of separate members for the sides and back, or may alternatively be a one-piece net. Further, when the apparatus is used as a ball return mechanism, a net preferably extends between the cross member, the back side members and a lower back cross member. This net may be the back net used for the soccer goal, or may alternatively be a separate net which has springy action to return a ball more efficiently.

The frame of this apparatus is preferably formed of polyvinyl chloride pipes which are connected by standard pipe connections. In this way, the construction is both relatively inexpensive to manufacture, and is easily convertible.

These and other objects and features of the present invention can be best understood from the following specification and drawings, of which the following is a brief description.

DETAILED DESCRIPTION OF PREFERRED EMBODIMENTS

Figure 1:
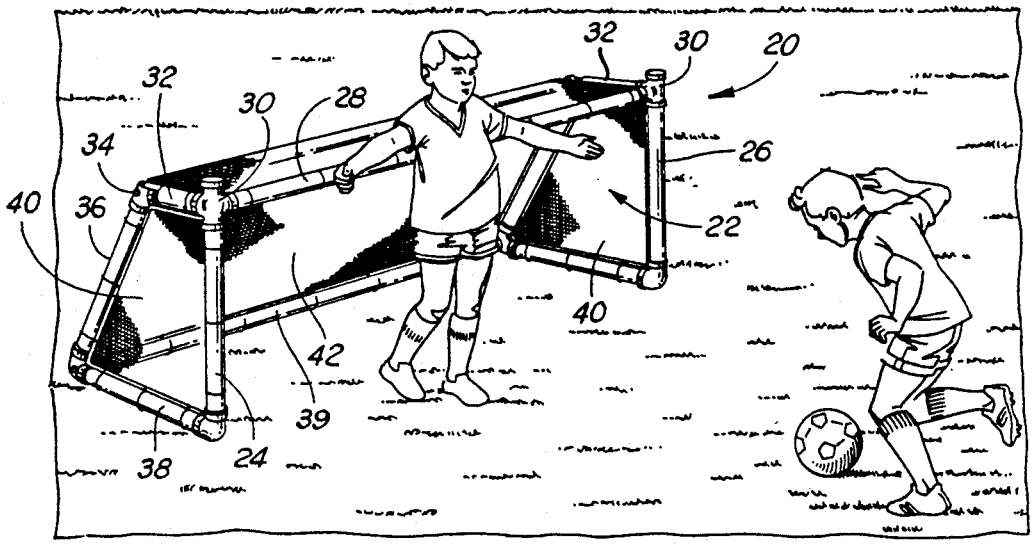
FIG. 1 is a perspective view of a first device formed from the convertible sports apparatus of the present invention.

Convertible sports apparatus 20 in illustrated in FIG. 1 in a first modification as goal 22. The goal may be used for soccer, hockey, or any sport or game which requires a goal. Goal 22 is formed by a pair of vertically extending columns 24 and 26 which are parallel and spaced from each other by a first distance. Upper cross member 28 is received in four-way connectors 30 and connected to vertical columns 24 and 26. Cross member 28 defines the upper extent of goal 22. A top side member 32 is also connected to four-way connector 30 and extends rearwardly from vertical columns 24 and 26. Pivot point 34 connects top side member 32 to back side member 36. Back side member 36 extends vertically downwardly and is connected by bottom side member 38 to a bottom of vertical columns 24 and 26. Bottom back cross member 39 extends across the first distance and connects the two back and bottom side members 36 and 38. Side net portion 40 may be received on each side, and back net portion 42 may extend between upper cross member 28 and bottom back cross member 39. Alternatively, a single net may be utilized to cover both the sides and back.

Figure 2:
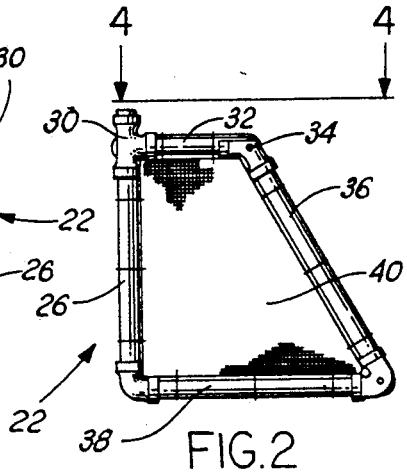
FIG. 2 is a side view of the device illustrated in FIG. 1.

As shown in FIG. 2, a side of goal 22 consists of bottom side member 38, back side member 36, vertical column 26, and top side member 32. Top side member 32 extends from four-way connector 30 to pivot point 34. Mount structure 45 is disposed around pivot point 34, and guides top side member 32 between two pivoted positions, as will be described below.

Figure 3:
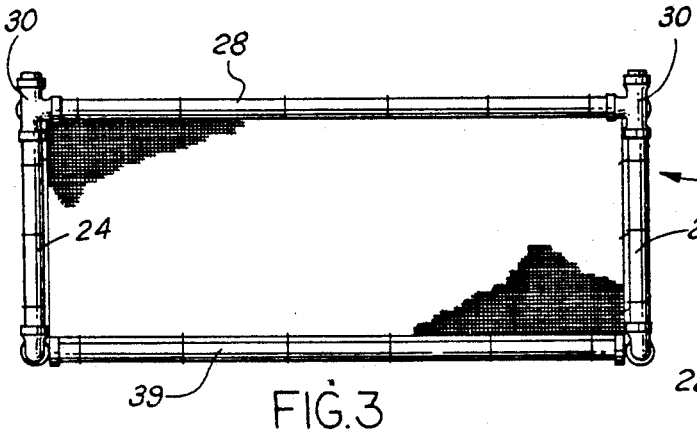
FIG. 3 is a front view of the device illustrated in FIG. 1.

FIG. 3 is a front view of goal 22. Vertical columns 24 and 26, upper cross member 29, and bottom back cross member 39 define an opening for a goal 22.

Figure 4:
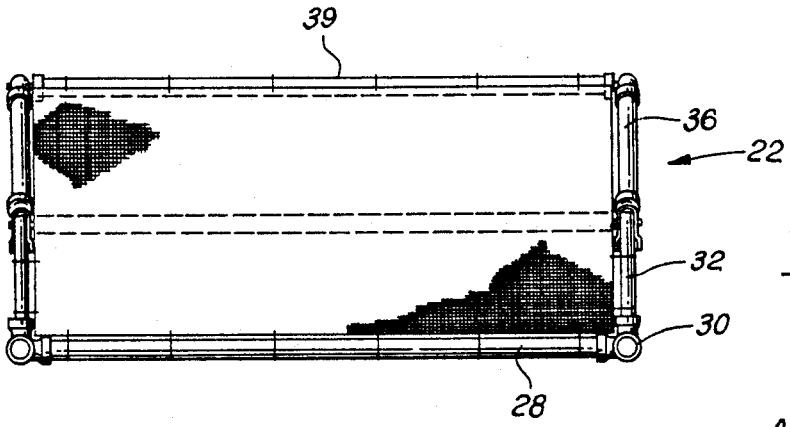
FIG. 4 is a top plan view along line 4—4 as illustrated in FIG. 2.

FIG. 4 is a top view along line 4—4 as shown in FIG. 2. Bottom back cross member 39 and upper cross member 28 define the front and back of goal 22. Back side member 36 extends to top side member 30, which is connected to the vertical columns through four-way connector 30.

Figure 5:
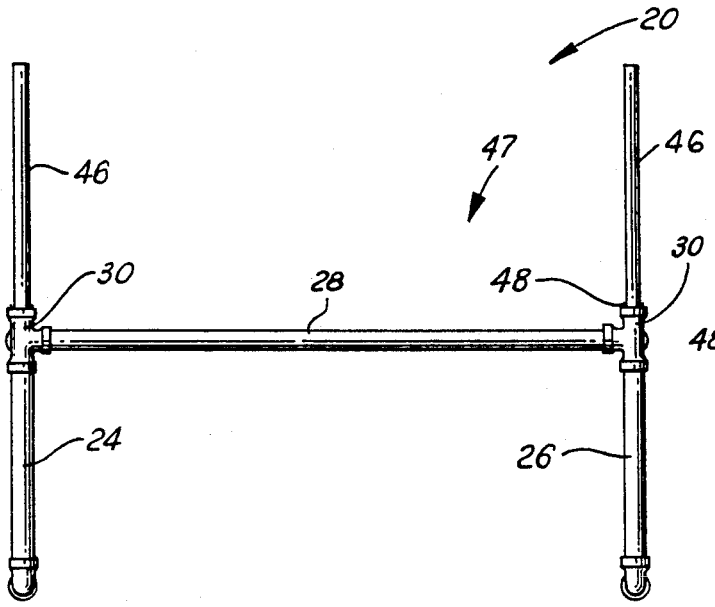
FIG. 5 is a front view of a second device formed from the convertible sports apparatus of the present invention.

A second modification 47 of convertible sports apparatus 20 is illustrated in FIG. 5. Vertical columns 24 and 26 are still spaced by the first distance, and upper cross member 28 still connects the two at four-way connectors 30. Uprights have been added to form a football goal post 47 in this second modification by moving telescopic posts 46 vertically upwardly from within vertical columns 24 and 26. Posts 46 are normally slidably received within lateral columns 24 and 26. Pin 48 is moved through an opening in post 46, to maintain post 46 outwardly of connector 30. This insures that posts 46 will not move downwardly back into columns 24 and 26.

Figure 6:
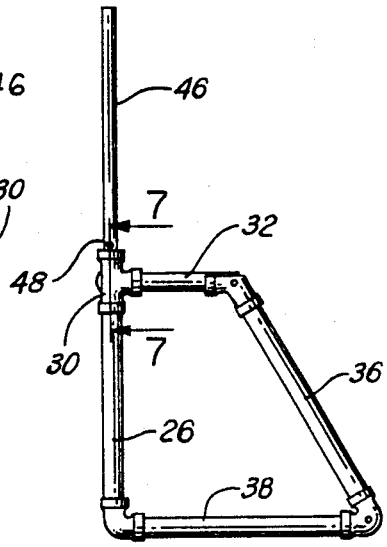
FIG. 6 is a side view of the device illustrated in FIG. 5.

As shown in FIG. 6, the side structure remains when convertible sport apparatus 20 is changed into goal post modification 47. The side structure, including top side member 32, back side member 36, and bottom side member 38 provides additional support to maintain goal post 47 upright.

As is evident, the relative scale of goal post 47 compared to goal 22 is not equivalent to the relative scale of their equivalent items for the professional sports of football and soccer. Convertible sports apparatus 20 is a novelty or toy device, and thus this scale difference is not critical.

Figure 7:
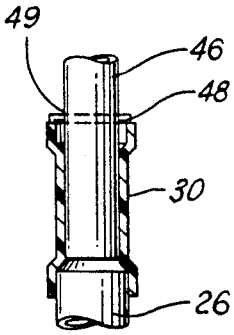
FIG. 7 is a view along line 7—7 as shown in FIG. 6.

FIG. 7 is a cross-sectional view along line 7—7 as shown in FIG. 6. The outer diameter of post 46 is smaller than the inner diameter of vertical column 26. Thus, post 46 may be received within the inner periphery of post 26. Pin 48 is selectively positioned through opening 49 in post 46 to secure post 46 vertically outwardly of four-way connector 30.

Figure 8:
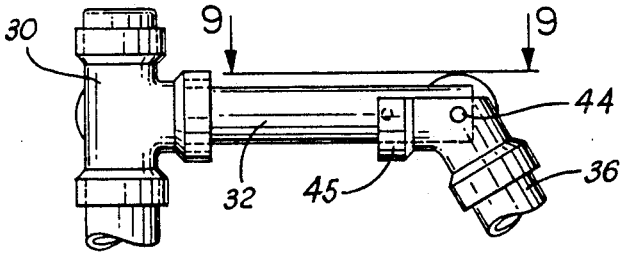
FIG. 8 is a detailed view of a portion of the device illustrated in FIG. 6.

FIG. 8 is an enlarged view of the structure of top side members 32. As shown, top side members 32 extend from four-way connector 30 rearwardly to pivot mount structure 45. Pivot point 34 extends through pivot mount structure 45, which is fixed to back side member 36.

Figure 9:
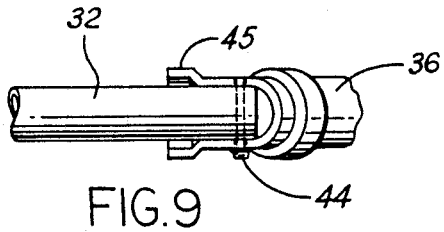
FIG. 9 is a cross-sectional view along line 9—9 as shown in FIG. 8.

FIG. 9 is a top view along line 9—9 as shown in FIG. 8. Pivot 34 extends through top side member 32, which is received between lateral walls of pivot mount structure 45.

Figure 10:
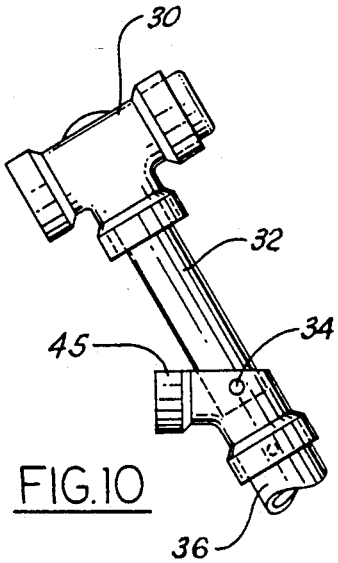
FIG. 10 is a partial view of a third device.
Figure 11:
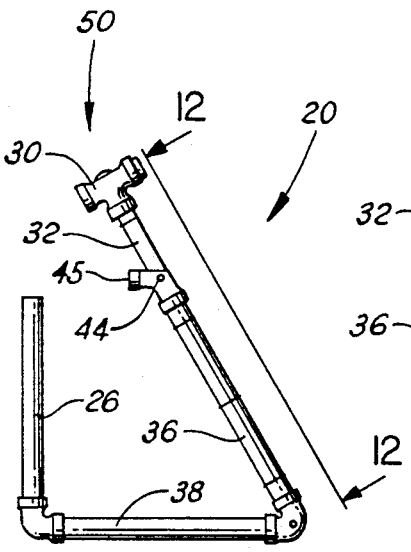
FIG. 11 is a side view of the third device.
Figure 12:
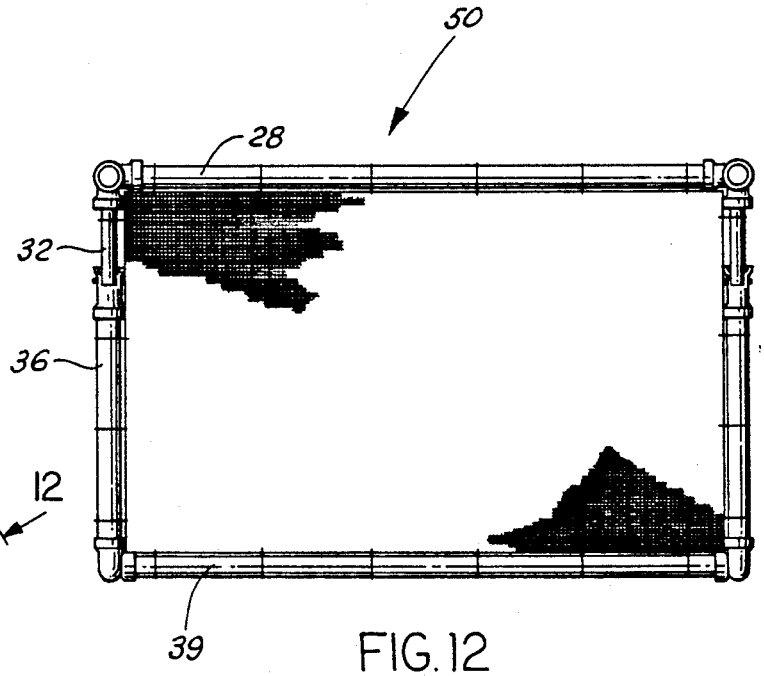
FIG. 12 is a view along line 12—12 as shown in FIG. 11.

FIG. 10 through 12 show a third modification of the convertible sport apparatus 20. FIG. 10 is an enlarged partial view of the movement of top side member 32 relative to vertical columns 26 and 24 to begin moving convertible sports apparatus 20 to the third modification. Four-way connectors 30 are removed from vertical columns 24 and 26. Four-way connectors 30 are simply received upon vertical columns 24 and 26, and are not secured, but are easily removable. Thus, when one wishes to move to the third modification, one removes four-way connectors 30 from columns 24 and 26, and pivots top side members 32 on pivot points 34 to the removed position illustrated in FIG. 10. When four-way connectors 30 are pivoted outwardly of columns 24 and 26, upper cross member 28 moves with them. Pivot 34 may then be locked in any known way, to maintain top member 32 in this position. Top member 32 now extends at approximately the same angle as back side member 36.

As shown in FIG. 11, convertible sports apparatus 20 is now a ball return mechanism 50 defined by back side members 36, top side members 32 and the upper cross member. Columns 24 and 26 and bottom side members 38 provide stability to ball return device 50.

As shown in FIG. 12, a net is connected to extend between side members 32 and 36 on each lateral side of ball return member 50. The net also extends between upper cross member 28, and bottom cross member 39.

The disclosed invention may be easily modified into three sports devices. When the apparatus is a goal, it is easily changeable into a football goal post by merely moving the telescopic posts 46 outwardly of columns 24 and 26. When the apparatus is in either the goal or goal post modifications, it is easily modified into a ball return mechanism by merely pivoting top side members 32 to their removed position as shown in FIGS. 10–12.

As described above, a separate net may be utilized for the ball return mechanism and the goal, or a single net may be left on the back of convertible sports apparatus 20. In such an embodiment, side nets 40 as shown in FIG. 1 would preferably be left unconnected to top side member 32. Thus, when the convertible sports device 20 is changed from goal 22 to a ball return mechanism 50, it is not necessary to disconnect any nets, but merely to pivot top members 32 relative to the remainder of the apparatus.

In a preferred embodiment of the present invention, all members are made from polyvinyl chloride pipe. Further, all connectors are also preferably polyvinyl chloride. The nets are preferably made of known net material such as nylon. Cords, such as bungy cords, may be utilized to provide extra elasticity. This is particularly valuable with the ball return mechanism. The nets may be attached to the pipes by looping them over hooks, similar to the way that a basketball net is attached to a basketball rim. In one preferred embodiment the angle described between the back side member and the bottom side member was approximately 45 degrees.

A preferred embodiment of the present invention has been disclosed, however, a worker of ordinary skill in the art would recognize that certain modifications would come within the scope of this invention. For that reason the following claims should be studied in order to determine the true scope and content of this invention.

I claim:

1. A convertible game apparatus comprising:

first and second elongated vertically extending columns, said columns being parallel to each other and spaced from each other by a predetermined distance, an elongated horizontally extending cross member having its ends attached to a respective upper end of said first and second columns, an area being defined laterally between said first and second columns and vertically below said cross member to define a goal opening;

each said first and second columns having an elongated member telescopically received therein and slidable therein to selectively extend vertically above said cross member and above said opening, said elongated members when extending above said cross member define a target laterally therebetween and vertically above said cross member;

a side structure attached to and extending rearwardly from said first and second columns, said side structure being comprised of a top side member attached to a back side member; and net means extending over said side structure and spanning said predetermined distance, said side structure and said net means in combination with said opening defines an object receiving and retaining goal.

2. An apparatus as recited in claim 1, wherein said cross member, said top side members and said first and second columns are connected by respective four-way connectors, said four-way connectors being removably received on said upper end of said first and second columns, said elongated members being movable vertically upwardly through said four-way connectors such that they extend vertically above said four-way connectors, pin members being inserted through said elongated members to secure said elongated members vertically above said four-way connectors.

3. A convertible game apparatus, comprising:

first and second elongated vertically extending tubular columns, said columns being parallel to each other and spaced from each other a predetermined distance;

an elongated horizontally extending cross member spanning said predetermined distance and connected at each end thereof by a connector to the upper end of a respective one of said first and second columns;

a side structure extending rearwardly from each of said first and second columns, each said side structure including an elongated top side member and an elongated substantially vertical back side member, each said top side member having one of its ends secured to a respective connector and its other end pivotally connected to one end of a respective back side member;

net means extending over said side structure and spanning said predetermined distance;

each said connector being releasably attached to said upper end of said first and second columns and said top side members are positioned at an angle relative to said first and second columns to define a first goal area in combination with said vertical columns; and said top side members being pivotable to a substantially upright position and parallel to said back side members to define a second goal area in combination with said vertical columns.

4. An apparatus as recited in claim 3, wherein said net means being tensioned on said apparatus such that an object propelled into said second goal area and against said net means will rebound therefrom.

5. An apparatus as recited in claim 3, wherein said first and second columns have posts which telescope outwardly of said vertical columns to define goal uprights.

6. An apparatus as recited in claim 3, wherein said back side members extend vertically upwardly and towards said first and second columns at an angle of approximately 45°.

7. An apparatus as recited in claim 3, wherein said first and second columns, said side structures and said cross member are all formed from pipe, and said connector is a pipe connector.

8. An apparatus as recited in claim 7, wherein said connectors are four-way connectors which are removably received on said first and second columns, and which connect said top side members and said cross member to said first and second columns.

9. An apparatus as recited in claim 8, wherein each said column slidably receive a post having an outer diameter that is less than the inner periphery of said first and second columns, each said post being slidably received within respective said first and second columns, said posts being selectively removable vertically upwardly outwardly of said first and second columns, and extending through said four-way connectors, such that said posts define the uprights of a goal post, and means to secure each said post in a vertically extended position.

* * * * *